United States Patent [19]

Diefendorff

[11] Patent Number: 4,868,765

[45] Date of Patent: Sep. 19, 1989

[54] PORTHOLE WINDOW SYSTEM FOR COMPUTER DISPLAYS

[75] Inventor: Keith E. Diefendorff, Austin, Tex.

[73] Assignee: Texas Instruments Incorporated, Dallas, Tex.

[21] Appl. No.: 815,688

[22] Filed: Jan. 2, 1986

[51] Int. Cl.[4] ..... G09G 1/00

[52] U.S. Cl. ..... 364/521; 340/723; 382/45; 364/518

[58] Field of Search ..... 364/518, 521; 340/703, 340/723, 747, 750, 798–800; 382/45–48

[56] References Cited

U.S. PATENT DOCUMENTS

| | | | |
|---|---|---|---|
| 4,542,376 | 9/1985 | Bass et al. | 364/521 X |
| 4,550,315 | 10/1985 | Bass et al. | 340/723 X |
| 4,633,415 | 12/1986 | Vink et al. | 364/521 |
| 4,642,790 | 2/1987 | Minshull et al. | 340/723 X |
| 4,648,049 | 3/1987 | Dines et al. | 340/723 X |
| 4,653,020 | 3/1987 | Cheselka et al. | 364/521 X |

*Primary Examiner*—Gary V. Harkcom
*Assistant Examiner*—H. R. Herndon
*Attorney, Agent, or Firm*—James T. Comfort; N. Rhys Merrett; Melvin Sharp

[57] ABSTRACT

A porthole window system for computer displays allows a user to look at a portion of a window which could otherwise not be seen. A porthole window acts as an opening in a window of the usual type through which underlying windows may be seen. A porthole window can have different features as desired, including links to selected source and target windows, real time movement on the display screen, and the ability to be updated when a target window is updated. The porthole system runs concurrently with the normal window handling system of the computer.

29 Claims, 5 Drawing Sheets

PORTHOLE WINDOW SYSTEM FOR COMPUTER DISPLAYS

BACKGROUND AND SUMMARY OF THE INVENTION

The present invention relates generally to computer systems and more specifically to window systems for computer system displays.

In order to improve the interface with an operator, many current computer systems use window systems for their display output. In a window system, several windows are used to receive computer output from different concurrently running processes, or different portions of output from a single process. A window can be thought of as a logical output device to which the computer can write.

On a cathode ray tube (CRT) display screen, a window is typically a rectangular region. The size, shape and location of the window may be changed by the user. In addition, windows may overlap each other, with underlying windows being partially or completely covered. This is often referred to as the desktop metaphor, in which each window resembles a piece of paper laying on a desk top. In the same way in which pieces of paper may be moved about on the desk top, and restacked so that different pieces of paper are exposed, the windows can be moved about on the display screen.

Even though a window may be partially or entirely covered, the computer will continue to write information to that window. Sometimes it is desirable for an operator to be able to observe a part of a particular window which is otherwise covered. This may be useful, for example, in determining the progress of processes running concurrently with one to which the operator's main attention is directed. However, it is not often easy, and sometimes not even possible to expose necessary portions of windows which are otherwise covered. It would be desirable to provide a mechanism whereby selected portions of covered windows can be displayed without significantly rearranging the windows in the display.

It is therefore an object of the present invention to provide a window system which allows partially or completely covered windows to be inspected while they otherwise remain covered.

Therefore, according to the present invention, a porthole window is generated in the window system. This porthole window provides an opening within upper layer windows which looks through into a covered window or a covered portion of a partially exposed window. This porthole window reflects any changes which are made to the covered window.

The novel features which characterize the present invention are defined by the appended claims. The foregoing and other objects and advantages of the present invention will hereafter appear, and for purposes of illustration, but not of limitation, three preferred embodiments are shown in the accompanying drawings.

DESCRIPTION OF THE PREFERRED EMBODIMENTS

The window system to be described below can be implemented with many standard window display systems used with commonly available computers. For example, the window system used by the Texas Instruments EXPLORER can be modified to produce the porthole window system as will be described, as can most currently available window systems. Many features of computer window display systems are in common use, and the preferred embodiments will be described in the context of such standard features.

Figure 1:
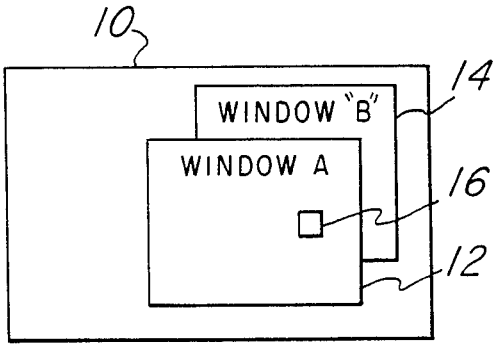
FIG. 1 shows a view of a computer display screen as seen by a user when using a windowing system according to the present invention.

FIG. 1 shows a computer display screen 10 having displayed thereon window A (12) and window B (14), which are displayed in a manner typical of window systems, and a porthole window 16 according to the present invention. In FIG. 1, only two regular windows 12, 14 are shown. However, it is understood that it is common to actually have many more than two windows displayed at one time. Two windows 12, 14 are used in FIG. 1 for simplicity in illustrating the present invention.

In a computer system, a window can be thought of as a logical output device to which information can be written. Different programs running concurrently can direct their output to different windows, or a single program can direct different parts of its output to different windows. These logical output devices receive all of the output from their respective programs, and do not necessarily display all of it on the display screen, which is a typically a cathode ray tube (CRT). A video controller device determines which portion of each window is to be displayed on the screen.

The windows are often considered to behave in a manner similar to pieces of paper on a desk top. The papers, and windows, can be laid in several different layers. One or more windows on top will be fully exposed, with those lying underneath either partially exposed or completely covered. A window that is completely covered can still receive output from its driving program, but none of such output will be reflected in the screen display.

In using a windowing system, a user typically points to a window with some sort of cursor positioning device such as a mouse, trackball or joystick, and enters one or more keystrokes to indicate that the window pointed to is to be brought to the surface. In this manner, windows which are partially hidden can be moved to the top, often in the process partially or completely overlying the windows which were previously on top.

A window may be referred to herein as partially or fully exposed, active, or selected. An active window is simply one which is capable of receiving output from the computer system. An exposed window is one which is partially or entirely shown on the screen display. A selected window is the logical device to which the computer keyboard is currently connected, and receives all input to the system made by the keyboard. When a window is thus selected, the program which drives such window must also be logically connected to the keyboard input. In most window systems, programs which are connected to non-selected windows do not receive input from the keyboard. In some window systems, a selected window must be fully exposed, and most systems require a selected window to be at least partially exposed.

In addition to being moved from underneath to the top (exposed), windows may be moved about on the screen and their sizes may be changed. This is typically done by using a mouse or other cursor positioning device in connection with one or more special function keys which indicate the operation to take place. Many window systems use a bit-mapped display, allowing various types of graphics to be combined with text within a window.

When numerous windows are active at the same time, it is often desirable to be able to see a small portion of a window which is not exposed. This may be necessary in order to check on progress of a program running concurrently with a user's primary application. One way of doing this would be to rearrange all of the windows on the screen so as to expose the necessary part of the underlying window in the usual manner. However, in many instances, this type of rearrangement is either not possible or inconvenient. A solution proposed by the present invention is to define a new type of window system device known as a porthole window, an example of which is shown as porthole window 16 in FIG. 1.

A porthole window 16 can be considered to be a small opening made in an upper layer window 12 in order to see through into an underlying window 14. The underlying window 14 can be partially exposed, as is window B in FIG. 1, or may be completely covered by other windows. The important fact is that the view through the porthole window 16 is precisely what would be seen in the corresponding portion of the underlying window 14 if such underlying window 14 were fully exposed. The top layer window 12 which has the opening in it will be referred to hereafter as the source window, while the window 14 which is partially exposed through the porthole 16 will be referred to as the target window.

Use of a porthole window 16 allows one to keep a desired small portion of a target window available for easy reference without having to rearrange the remaining windows on the screen.

Figure 2:
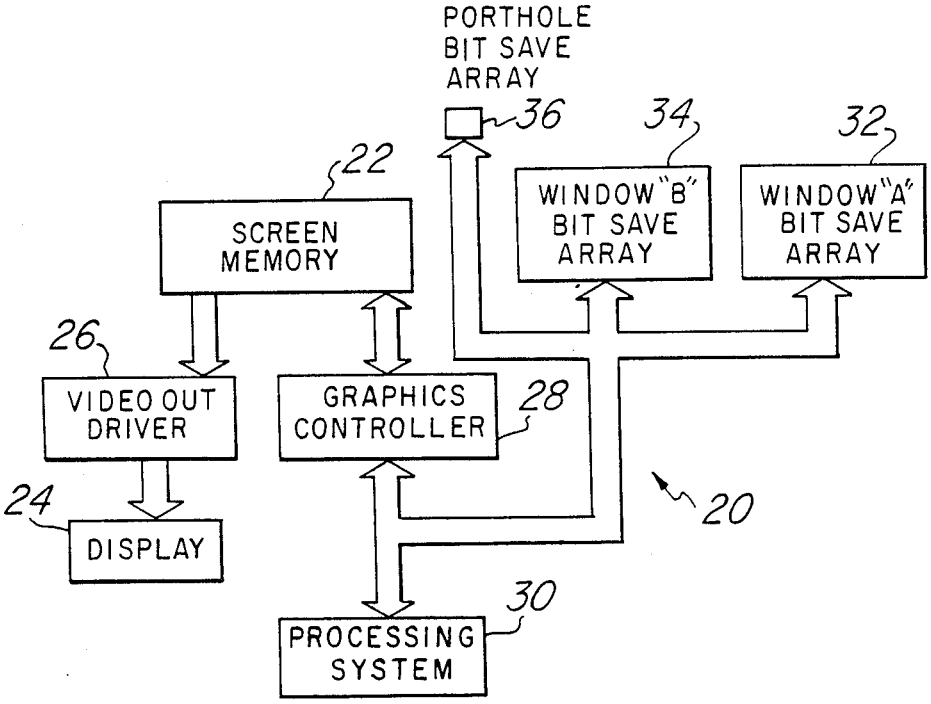
FIG. 2 is a block diagram of a computer system utilizing a porthole window according to the present invention.

Referring to FIG. 2, a system 20 which can be used to implement the porthole window concept is shown. A screen memory 22 is used to store a bit map of the information to be displayed on a display device 24. A video output driver 26 reads the screen memory 22, and develops the driving signals for the display device 24, typically a CRT. In order to increase performance, the screen memory 22 is typically a dual port video RAM, such as is commercially available from Texas Instruments, Incorporated of Dallas, Texas.

A graphics controller 28, or window controller, is used to put the information that is desired to be displayed into the screen memory 22. The graphics controller 28 works almost independently of the video output driver 26. Except for certain timing considerations, the graphics controller 28 can write into the screen memory 22 as desired, without regard to the details of driving the display device 24 from the screen memory 22.

The graphics controller 28 handles all of the low level tasks of writing to and from the screen memory 22, and is coupled to the processing system 30. The processing system 30, which can be any general purpose computer, generates output which is to be sent to the logical windows. The graphics controller 28 is then responsible for updating the screen memory 22 and handling the low level details of the window system. In many systems, the graphics controller 28 and video output driver 26 functions are combined and handled by a single group of devices, and in other systems the graphics controller 28 is actually a part of the main processing system 30. These functions have been separated in FIG. 2 as a preferred embodiment and for clarity in explaining the present invention. As shown, only the graphics controller 28 can write directly to the screen memory 22. If the functions of the graphics processor 28 are absorbed by the processing system 30, the processing system 30 could also write directly to the screen memory 22.

In much the same manner that each sheet of paper on a desk top is complete and has all of its information at all times, memory is preferably set aside and maintained for containing the complete contents of all currently active windows. Thus, the system 20 has a logical device to write to even if the associated window is not displayed on the display device 24. Each logical window device consists of a bit save array located somewhere in memory, and which is accessable by the graphics controller 28. For the example shown in FIG. 1, window A and window B each have their own bit save array 32, 24 contained in memory. The graphics controller 28 is responsible for copying the appropriate parts of each bit save array 32,34 to the screen memory 22 so that the windows 12,14 appear to overlap as shown in FIG. 1.

When a porthole window 16 is opened with window A as the source and window B as the target, a separate bit save array 36 is preferably set aside for this porthole 16. The relevant portion of the target window 34 is copied into the porthole bit save array 36. This is preferably done using a block transfer as known in the art, so that this is a very fast operation. Such a block transfer is often referred to as a bitblt, for bit-mapped block transfer. When the graphics controller 28 writes the relevant portions of windows A and B to the screen memory 22, it also writes the porthole bit save array 36 to screen memory 22 in order to provide the porthole window 16 as shown in FIG. 1.

Depending on the characteristics of the graphics controller 28, it may be possible or desirable to merely copy the selected part of the target window, window B, to the screen memory 22 without saving it in a separate bit save array 36. However, in many instances, it will be simpler to maintain a separate porthole bit save array 36, and the cost of the extra memory will usually not be significant.

When the target window 14 is updated, the porthole bit save array 36 may also need to be updated in order to reflect any changes which were made within the area shown by the porthole 16. This can again be done by a block transfer, so that system performance is not adversely affected.

Figure 3:
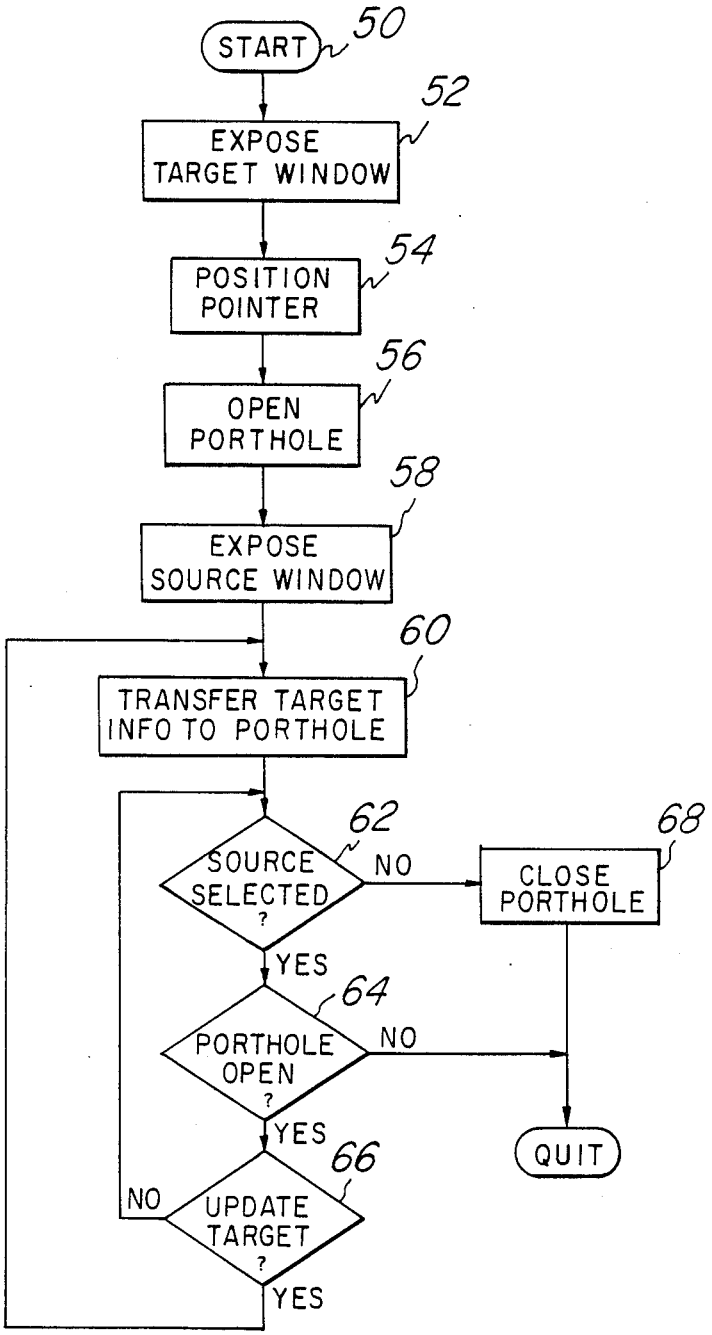
FIG. 3 is a flowchart illustrating the operations performed by a porthole window control system according to one embodiment of the present invention.

Referring to FIG. 3, a flowchart illustrating a series of processing steps which may be used by the system 20 of FIG. 2 in order to create and maintain a porthole window 16 such as shown in FIG. 1 is described. This routine is a routine running in the graphics controller 28 concurrently with the standard functions within such controller 28. The porthole window routine starts when a user indicates through the use of a special function key that a porthole window is desired to be opened. The start step 50 of this routine includes changing the state of the processing system 20 in order to perform the steps immediately following.

The first step 52 is to expose the target window 14, which means bringing such window to the top so that it is completely exposed. The next step 54 is to position the pointer, again usually controlled by a mouse, at that portion of the target window 14 that is desired to be shown through the porthole. The open porthole step 56 involves defining an area within the target window 14 in a manner similar to that in which a window is normally opened. For example, the pointer can be positioned at the lower left corner of the desired porthole area, a button on a mouse depressed, the pointer moved to the upper right corner of the desired porthole area, and the mouse button again depressed in order to complete definition of the porthole area. The next step 58 is to again expose the source window 12, which is generally brought back to the same location which it previously occupied. At this time, the porthole window 16 remains open, showing a view of a selected area from the target window 14. This is done by transferring the selected part of the target window bit save array 34 to the porthole bit save array 36 (step 60) as previously described, and in turn copying the porthole bit save array 36 to the screen memory 22.

The remainder of the steps 60,62,64,66 in the flowchart of FIG. 3 comprise a loop which runs concurrently with the remaining operations being continually undertaken by the graphics controller 28. One pass through the loop will typically be made each time the keyboard and other input devices are scanned by the normal input scan routine. In step 62, the graphics controller 28 first checks to see if the source window 12 is still selected, i.e. still the preferred logical device for receiving keyboard input. If so, in step 64 the graphics controller 28 also checks to insure that the porthole 16 is still open. The user can close the porthole 16 at any time by entering an appropriate sequence of keystrokes.

If the porthole 16 remains open at step 64, the graphics controller 28 determines whether or not the target window 14 has been updated since the last pass through the loop at step 66. If the target window 14 has been updated, it is necessary to make a block transfer of the revelant target window 14 information from the target bit save array 34 to the porthole bit save array 36. This is accomplished by branching back to step 60. If the target window 14 has not been updated, the graphics controller 28 takes the NO branch and returns to the top of the loop at step 62.

If the source window 12 is no longer selected at step 62, the graphics controller 28 causes the porthole 16 to be closed, and the porthole bit save array 36 to be freed and released to the system. The porthole window routine then quits. If the porthole window 16 is closed even though source window 12 is still selected at step 64, the NO branch is taken and the porthole routine terminates.

Other implementations of the porthole window concept are of course possible. As described in the first preferred embodiment, the porthole window 16 cannot be moved once it is opened. Also, the porthole 16 is automatically closed when the source window 12 is deselected. This means that if some third window (not shown) is brought to the top of the stack and used for some period of time, the porthole window 16 is no longer available when the source window is 12 again selected.

However, slight changes in the operation of the porthole window routine for the graphics controller 28 allow such features to be implemented. For example, if it is desirable that the porthole window 16 remain, the graphics controller 28 can consider the porthole 16 to be a permanent link between the source window 12 and the target window 14 wherever they may be, until the porthole 16 is positively closed. This would involve retaining the porthole bit save array 36 until the porthole 16 was closed and retaining a flag indicating that the porthole 16 is still considered to be opened in the source window 12. It is possible to have multiple portholes by merely increasing the number of porthole bit save arrays which can be accessed by the video controller 21. This is a fairly straight-forward operation.

Other desirable features can be easily implemented. For example, the porthole window 16 described thus far is a read only window. However, since the porthole bit save array 36 operates in a manner similar to a normal window bit save array, it is possible that the porthole window 16 could be allowed to be selected, with keyboard input directed thereto. If this were the case, it would be necessary to copy the changes made to the porthole bit save array 36 back to the target bit save array 34 whenever such changes were made.

Another possible feature is to consider the porthole window 16 to be a telescope. When a porthole 16 is linked to a source window 12 as described above, the porthole 16 will be covered when that source window 12 is covered. However, if the porthole 16 is flagged as a telescope, it will be left displayed on the screen memory regardless of how many other windows are placed on top of the original source window 12. In this manner, a telescope view can always be had to the target window 14 regardless of what other changes are made to the layouts of the windows generally. Implementation of this feature obviously requires that the porthole 16 is not automatically closed when the original source window 12 is deselected, as is the case in the first preferred embodiment.

Usually, the porthole will be located directly over that portion of the target window that is reflected in the porthole. This is not necessary, however. Once the link between the target window and the porthole has been made, the porthole can be moved to a new location on the display just like any other window. This can be thought of as a flexible porthole window. Use of a flexible porthole allows one or a group of portholes to be placed in a convenient location on the screen, with the convenient location being completely independent of the locations of the various target windows. As long as the logical link exists between the porthole bit save array and the target window bit save array, the actual screen location of the porthole window is not necessarily fixed.

Figure 4:
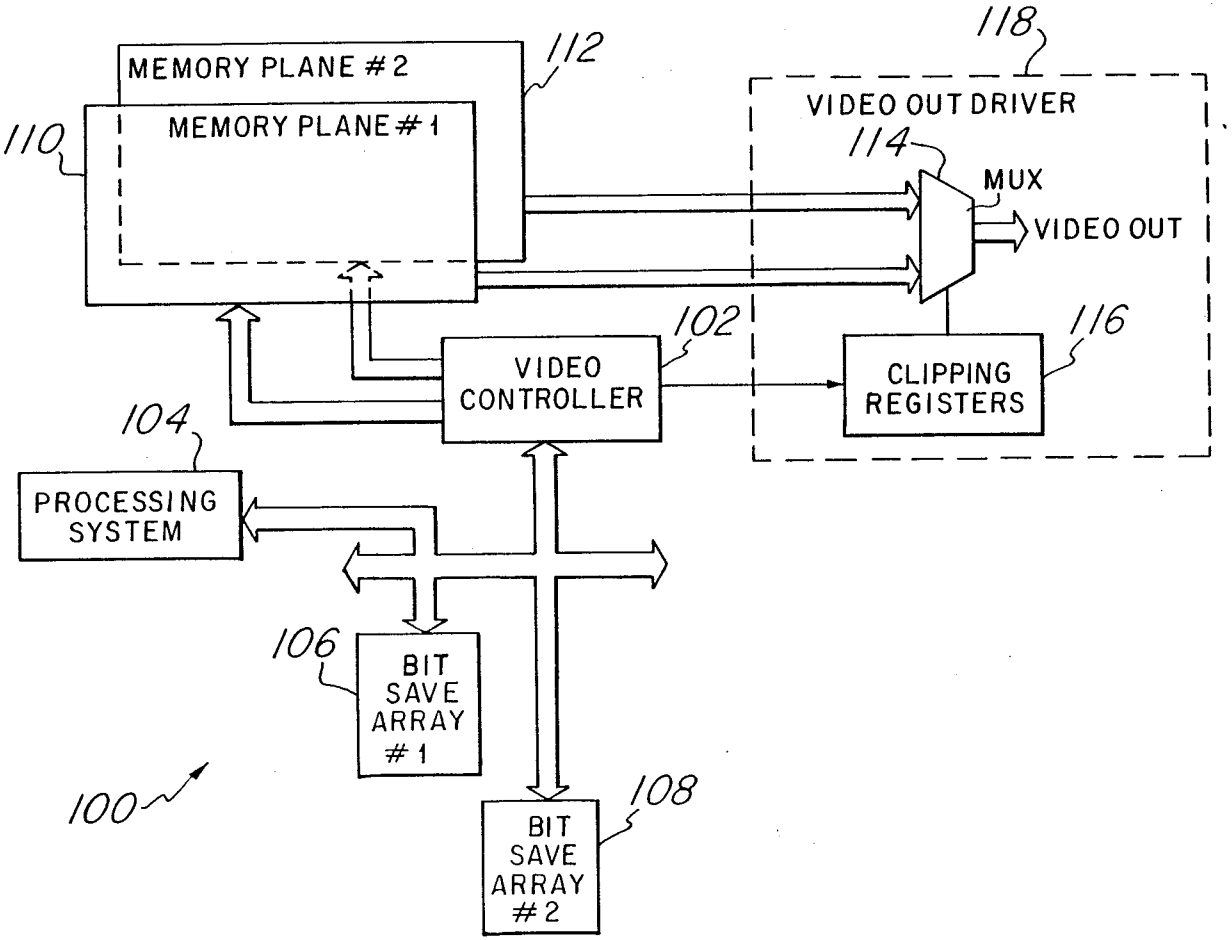
FIG. 4 is a block diagram of a computer system including the use of porthole windows according to a second preferred embodiment.

FIG. 4 shows a preferred embodiment of a system 100 which can be used to create porthole windows which can be moved about a display screen in real time. It is possible to create such a system with the device of FIG. 2, but for reasons of performance it is preferred that the device of FIG. 4 be used with such porthole window systems.

The system 100 of FIG. 4 is similar to that of FIG. 2 in that a graphics controller 102 is coupled to a processing system 104 and to bit save arrays 106,108 for the various windows. In this preferred embodiment, there are two screen memories 110,112, referred to as Memory Plane No. 1 and Memory Plane No. 2, connected to the graphics controller 102. The output from these memory planes 110,112 are coupled to a multiplexer 114 controlled by clipping registers 116. A VIDEO OUT signal is generated by the multiplexer 114. The multiplexer 114 and clipping registers 116 are contained within a VIDEO OUT DRIVER 118, which drives a video display as shown in FIG. 2. The clipping registers 116, or some other type of indicating device, are also connected to the graphics controller 102.

In this preferred embodiment, the regular windows are displayed in a static manner on the screen. That is, it is not expected that these regular windows will be moved about the screen in real time. These windows are all placed in Memory Plane No. 1, which is normally selected by the multiplexer 114 to generate the VIDEO OUT signal. When it is desired to open a porthole 16, the target window 14 is copied onto Memory Plane No. 2. The numbers held in the clipping registers 116 define the location and extent of the porthole 16. Memory Plane No. 1 and Memory Plane No. 2 are scanned at the same time, and both generate signals suitable for VIDEO OUT. When the clipping registers 116 indicate to the graphics controller 102 that the scanning of Memory Plane No. 1 is entering the region of a porthole window 16, the graphics controller 102 changes the signal to the multiplexer 114 to cause VIDEO OUT to be taken from Memory Plane No. 2. As the video scan leaves the porthole, the clipping registers 116 cause the graphics controller 102 to switch the multiplexer 114 back to its normal state so that the VIDEO OUT is again taken from Memory Plane No. 1.

This allows performance of the system to be improved substantially if it is desired that the porthole window (16) be moved in real time. Instead of having to accomplish numerous block transfers whenever the porthole window position is changed, it is merely necessary to change the numbers located in the clipping registers 116. This allows the user to, for example, open a porthole window and then move it around until the desired part of the target window is contained therein.

Figure 5:
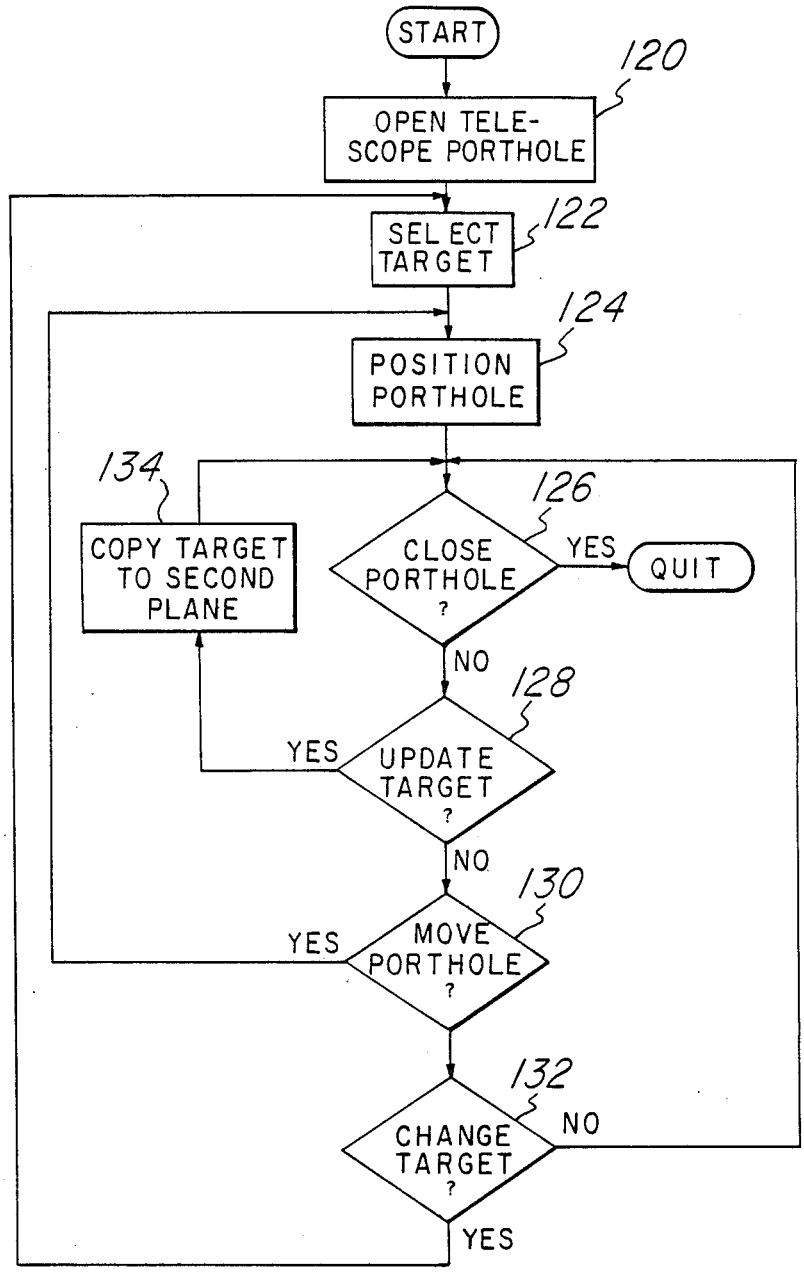
FIG. 5 is a flowchart illustrating the operation of the porthole window control system of the window control system of FIG. 4.

A routine to operate the graphics controller of FIG. 4 in the manner just described is shown in FIG. 5. The routine of FIG. 5 implements a telescope porthole as described above. The first step (120) is to open the telescope porthole in the current source window. This involves defining the size and shape of a porthole, which is currently blank. The size and shape definition can be done in the same manner as the open porthole step 56 of FIG. 3. The next step (122) is to select the target window. This can be done by means of entering some type of window identification at the keyboard, by cycling through all windows which are currently beneath the porthole and showing the relevant parts thereof within the porthole itself, or by other means as may be implemented in a particular system. A block transfer of the proposed target window must be made to the Memory Plane No. 2 in order to complete this step. The next step 124 is to position the porthole if desired. To do this, the user must merely indicate that he desires to move the porthole, and then move a pointing device to the desired location. The porthole will appear to move in real time, and follow the user's manipulation of the location of the pointing device. This is possible because no block transfers need be made; it is only necessary to change the clipping registers 116 coupled to the graphics controller 102.

The graphics controller routine now enters a loop in which it will remain until the window is closed. The first step 126 in the loop is to check to see if the porthole has been closed by the user. If so, the routine is over. If not, the routine then checks (step 128) to see if the target has been updated. If so, it is necessary to copy at least the changed portions of the target to the Memory Plane No. 2 in step 134. This is accomplished by a block transfer from the target window bit save array to the Memory Plane No. 2. If the target has not been updated, it is then necessary to check (step 130) to see if the porthole is moved by the user. If so, it is necessary to return to the position porthole step as described above. If the porthole has not been moved, the controller checks to see if the target has been changed (step 132). If the target has not been changed, the controller goes back to the top of this small loop and continues with step 126. If the target has been changed, a new target can be selected as described above, and the following steps repeated.

Since this porthole was opened as a telescope porthole window, the porthole remains regardless of whether or not any changes are made in the locations of the source window or any other windows. Thus, there is no check in the routine of FIG. 5 as to whether or not the original source window was closed, deselected, and so forth. The telescope porthole will only be closed when it is explicitly closed by the user.

As can now be seen from the description of the first two preferred embodiments, a porthole window is related to, but different from, a normal window. A real window acts as a place to which the computer system can send information. In contrast, a porthole does not receive information directly as an output device. It is, instead, a copy or view of a window. The porthole may be thought of as a hole through which a user can peer in order to see things which are normally hidden from view. However, the concept of a porthole is more flexible than a simple hole made in a window.

Figure 6:
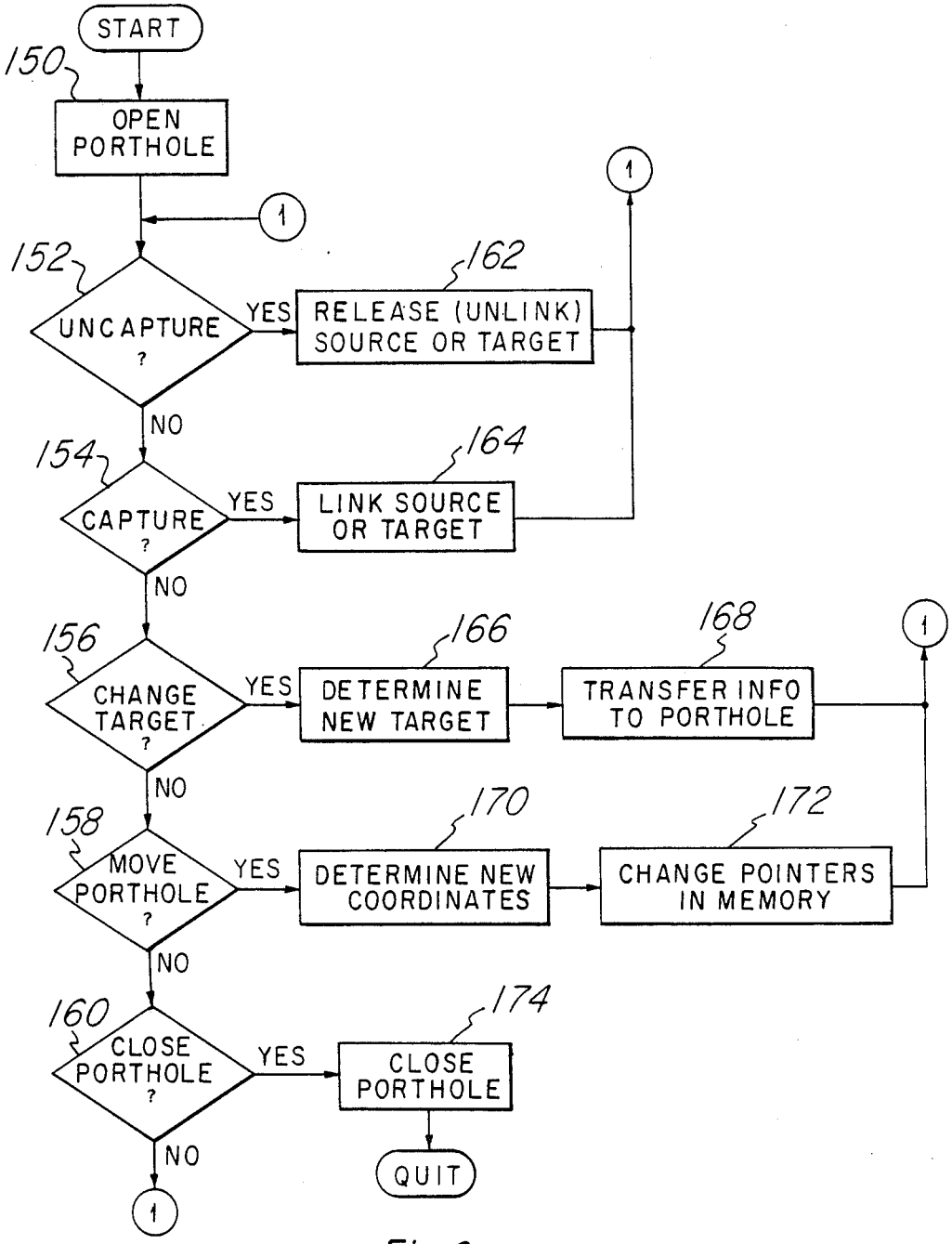
FIG. 6 is a flowchart illustratiing the operation of a third porthole window control system.

Referring to FIG. 6, a flowchart illustrates the control mechanism by which one of the previously described window control systems can provide additional features to a porthole control system. A primary new feature introduced in this embodiment is the concept of capturing and uncapturing source and target windows. When the porthole of the third embodiment is initially created, it is not linked with either a source or target window. In this embodiment, links between the porthole and the source and target windows may be made and broken as desired. This gives the user the ability to change targets while looking through a porthole, and to retain any established links while repositioning the porthole.

The system of FIG. 6 also embodies the concept of a snapshot porthole. In this embodiment, a single block transfer is made from a target memory to a porthole memory, and the porthole is not updated when changes are made to the target. Also in this embodiment, the concept of a telescope porthole is embodied as a subset of the capture/uncapture feature. When no source window is captured, the porthole is treated as being linked to the top level display, and will remain in place regardless of window repositioning, therefore acting as a telescope as described above. Capturing a source window establishes a link between such source and the porthole, thereby removing the telescope effect. That is, if the newly captured source window is covered by another window, the porthole is also covered.

Referring to FIG. 6, in the creation of such a porthole, the first step 150 is to open the porthole. Initial screen position and the size and shape of the porthole are established, and a bit save array is set aside in memory. The control sequence now enters a loop in which it remains until the porthole is closed by the user. This loop consists of a sequence of tests in which any status changes in the porthole are checked. Step 152 is a check to see if any previously captured source or target window is to be uncaptured. Step 154 is a check to whether a source or target window is to be captured and linked to the porthole. Step 156 is a check to see whether the target is to be changed. Step 158 is a check to see whether the porthole is to be moved to a new location on the display. Step 160 is a check to see whether the porthole is to be closed. If all of these checks give a no result, then the loop is reentered prior to Step 152 and the process repeated. If an uncapture has been detected in Step 152, the source or target window, as appropriate, is released, or unlinked, in Step 162. If a previously captured target window is released, the user is now free to search for a new target window. If the source window is uncaptured, the porthole becomes a telescope porthole as described above. The loop is then reentered prior to step 152.

If a capture is detected in Step 154, a link is established, to the source or target as appropriate, in Step 164. It makes sense for a new link to be established only if there is no existing link to the source or target which is to be captured. The establishment of this link causes the porthole to behave in the manner previously described. After the link is made, the loop is reentered.

If a target change is detected in Step 156, a determination is made of the new target. This may be done by cycling through all targets currently available beneath the location of the porthole window by repeatedly depressing a button on a mouse, for example, or any other method which is consistent with the user's window system. Since this porthole implementation incorporates a snapshot feature as described above, it is not necessary to update the porthole when changes are made to the target window. When a new target is selected, the appropriate information from the newly selected target memory is block transferred to the porthole memory in Step 168. The loop is then reentered at the top.

If a porthole move is detected in Step 158, the new location of the porthole is determined in Step 170. This may be done by any method, and will typically involve repositioning the pointing device. Once the new location is selected, the appropriate pointers are changed in memory so that the graphics controller will display the porthole in the desired location. The loop is then reentered at the top.

If Step 160 detects a closing of the porthole, the porthole is closed in Step 174. This involves removing various pointers and control information, dependent upon the particular implementation of the porthole system, and releasing the porthole memory to the system for further use. The routine then quits.

Any number of portholes can be supported by a porthole system using the routine in FIG. 6. A separate routine can be run concurrently for each porthole, thereby minimizing interference between the control functions of the various portholes.

Many different desirable features have been described and illustrated with the three preferred embodiments described above. Any particular implementation of a porthole window system may include all or some of these desired features in its particular implementation.

TECHNICAL ADVANTAGES

The described porthole window system allows a user to create an opening to a part of an otherwise covered window in order to observe it. This is done without having to reorganize the windows on the video display screen.

The present invention has been illustrated by the embodiments described above, and it will become apparent to those skilled in the art that various modifications and alterations may be made thereto. Such variations fall within the spirit of the present invention, the scope of which is defined by the appended claims.

What is claimed is:

1. A system for generating porthole windows for a computer display, comprising:

a screen memory;

an output driver connected to the screen memory and to the display for converting the contents of the screen memory into a signal suitable for use by the display;

at least one bit save array memory for holding the contents of information windows; and a controller coupled to said screen memory and to said bit save array memories for selectively transferring the contents of the bit save array memories to the screen memory, and for selectively transferring information between selected bit save arrays, wherein at least one selected portion of a bit save array is not transferred to said screen memory;

wherein said controller includes a porthole bit save array which contains an exact copy of a selected portion of one of said bit save arrays which is not transferred to said screen memory from said bit save array, wherein said porthole bit save array is updated to reflect any changes which are made in the selected portion, and wherein the contents of the porthole bit save array are transferred to said screen memory by said controller.

2. The system of claim 1, wherein said porthole bit save array is contained in memory directly addressable only by the controller.

3. The system of claim 2, wherein said bit save arrays are directly addressable only by the controller.

4. The system of claim 1, wherein the porthole bit save array occupies a separate location in memory from any of said bit save array memories.

5. The system of claim 1, wherein the porthole bit save array occupies the same memory location as the selected portion of one of said bit save arrays.

6. In a computer system having a window system display, a method for generating a porthole window, comprising the steps of:

(a) copying selected information from a first window memory to a porthole memory;

(b) copying selected information from a plurality of window memories to a screen memory, wherein the select information copied in step (a) is not copied from the first window memory to the screen memory, and wherein the contents of the screen memory will be displayed in the window system display; and (c) copying the contents of the porthole memory to the screen memory, wherein the contents of the porthole memory will be displayed in the window system display.

7. The method of claim 6, wherein, in step (b), at least a portion of the first window save memory is copied to the screen memory.

8. A system for generating porthole windows for a computer display, comprising:

a screen memory;

an output driver connected to the screen memory and to the display for converting the contents of the screen memory into a signal suitable for use by the display; and a controller for transferring information to such screen memory to define windows therein, wherein said controller defines a porthole memory which contains a copy of a selected portion of one of an overlapped window, wherein the information in the porthole memory is also transferred to said screen memory, and wherein the selected portion includes information which would not be, except for the porthole memory, transferred to said screen memory.

9. The system of claim 8, further comprising a plurality of predefined memory locations wherein the information contained in the windows is stored.

10. The system of claim 9, wherein said porthole memory and said window memories comprise bit save arrays.

11. The system of claim 8, wherein the information in the porthole memory is updated to reflect any changes which are made in the selected portion.

12. The system of claim 8, wherein the porthole memory occupies a separate location in memory from any of the windows.

13. The system of claim 8, wherein the porthole memory occupies the same location in memory as the selected portion of one of said windows.

14. A method for displaying information on a computer output device, comprising the steps of:

(a) defining at least two overlapping windows of information at least one of which has a selected portion of information, and at least one of which has a non-selected portion of information;

(b) defining a porthole which contains a selected area of the non-selected portion of information; and (c) displaying on the output device the selected portions of the said overlapping windows of information defined in step (a), and the information in the porthole at the selected location.

15. The method of claim 14, wherein the selected subset of step (b) contains less than the entire non-selected portion of information.

16. The method of claim 14, wherein the porthole contains a selected subset of non-selected information from exactly one window.

17. The method of claim 16, wherein the selected subset contains less than the entire non-selected portion of the window.

18. The method of claim 14, further comprising:

(d) defining at least one additional porthole which contains a selected subset of a non-selected portion of information which is not identical to the selected subset of step (b); and (e) displaying on the output device the information in the additional porthole defined in step (d).

19. The method of claim 14, wherein the porthole is rectangular.

20. The method of claim 14, wherein any change to a window having a porthole corresponding to a non-selected portion of information causes the porthole to be updated to reflect the information currently in the selected subset.

21. A method for organizing information on a computer display, comprising the steps of:

(a) defining a plurality of windows containing information;

(b) displaying said windows on the computer display, wherein at least one window is defined to be wholly or partially covered by a portion of at least one other of the windows, and wherein any covered window parts are not selected for display;

(c) defining a porthole which contains a copy of a selected covered window part; and (d) displaying said porthole at a select location on the computer display.

22. The method of claim 21, wherein the porthole is positioned on the display in the same location as the selected covered window part would be located if it were not covered.

23. The method of claim 21, wherein the porthole continues to be displayed even if another window is positioned to cover a portion thereof.

24. In a window display system for an electronic computer, wherein a plurality of overlapping windows are displayed, and wherein portions of windows which are overlapped by other windows are not displayed, the improvement comprising:

a target window, having a first selected region therein, at least a portion of the first selected region being overlapped by another window, whereby the first selected region is not displayed;

a porthole window, said porthole window containing a copy of information which is in the first selected region of the target window; and a source window, wherein a second selected region thereof is covered by said porthole window.

25. The system of claim 24, wherein the entire first selected region is covered by at least one other window.

26. The system of claim 25, wherein said porthole window is linked to said source window, wherein said porthole window is displayed only to the extent that the second selected region is not covered by another window.

27. The system of claim 25, wherein the first and second selected regions coincide in the location in which they would be displayed if they were not covered by other windows or portions thereof.

28. The system of claim 25, wherein a new target window can be selected, whereby the information in said porthole window is changed to match the information contained in a third selected region in the new target window.

29. The system of claim 25, wherein a new source window can be selected, whereby the information contained in said porthole window covers a third selected region in the new source window.

* * * * *